US010359037B2

(12) United States Patent
Yaeguchi et al.

(10) Patent No.: US 10,359,037 B2
(45) Date of Patent: Jul. 23, 2019

(54) PERISTALTIC PUMP HAVING ADJUSTABLE ROLLER GUIDING PARTS

(71) Applicant: MINEBEA MITSUMI Inc., Nagano (JP)

(72) Inventors: Koichi Yaeguchi, Sumida-ku (JP); Hiroyuki Ohmae, Kawasaki (JP)

(73) Assignee: MINEBEA MITSUMI INC., Nagano (JP)

( * ) Notice: Subject to any disclaimer, the term of this patent is extended or adjusted under 35 U.S.C. 154(b) by 0 days.

(21) Appl. No.: 15/709,525

(22) Filed: Sep. 20, 2017

(65) Prior Publication Data

US 2018/0003168 A1 Jan. 4, 2018

Related U.S. Application Data

(63) Continuation of application No. PCT/JP2016/060760, filed on Mar. 31, 2016.

(30) Foreign Application Priority Data

Mar. 31, 2015 (JP) ..... 2015-072775

(51) Int. Cl.
*F04B 43/08* (2006.01)
*F04B 43/12* (2006.01)
(Continued)

(52) U.S. Cl.
CPC ..... *F04B 43/1276* (2013.01); *F04B 43/08* (2013.01); *F04B 43/1269* (2013.01);
(Continued)

(58) Field of Classification Search
CPC ..... F04B 43/1276; F04B 45/08; F04C 5/00
See application file for complete search history.

(56) References Cited

U.S. PATENT DOCUMENTS 3,447,478 A * 6/1969 Clemens ..... F04B 43/1253 417/477.8
3,787,148 A * 1/1974 Kopf ..... F04B 43/1276 417/477.8

(Continued)

FOREIGN PATENT DOCUMENTS

CN 101622453 A 1/2010
DE 3912310 A1 11/1989

(Continued)

OTHER PUBLICATIONS

International Search Report dated Jun. 28, 2016 for corresponding International Application No. PCT/JP2016/060760.

(Continued)

*Primary Examiner* — Bryan M Lettman
*Assistant Examiner* — Timothy P Solak
(74) *Attorney, Agent, or Firm* — Pearne & Gordon LLP

(57) ABSTRACT

A rotor includes a rotary body configured to rotate about a rotational shaft; a plurality of bottom parts attached to the rotary body; a plurality of arm parts that have respective rollers configured to revolve around the rotational shaft and depress a tube, and are attached to the respective bottom parts; and an adjuster that adjusts the mutual positional relation between the bottom parts in the radial direction of the rotation of the rotary body.

9 Claims, 12 Drawing Sheets

(51) Int. Cl.

| | |
|---|---|
| ***F04B 45/08*** | (2006.01) |
| *F04B 35/04* | (2006.01) |
| *F04B 17/03* | (2006.01) |
| *F04C 5/00* | (2006.01) |

(52) U.S. Cl.
CPC ..... *F04B 45/08* (2013.01); *F04B 17/03* (2013.01); *F04B 35/04* (2013.01); *F04C 5/00* (2013.01)

(56) References Cited

U.S. PATENT DOCUMENTS

| | | | | |
|---|---|---|---|---|
| 5,215,450 | A * | 6/1993 | Tamari | A61M 1/0031 138/119 |
| 8,262,375 | B2 | 9/2012 | Koima et al. | |
| 2003/0156957 | A1* | 8/2003 | Domroese | F04B 43/1253 417/477.7 |
| 2010/0047100 | A1 | 2/2010 | Kojima et al. | |
| 2012/0100023 | A1* | 4/2012 | Hanazuka | F04B 43/1276 417/477.7 |
| 2015/0252800 | A1 | 9/2015 | Buckberry et al. | |

FOREIGN PATENT DOCUMENTS

| | | | |
|---|---|---|---|
| JP | 05-073281 | U | 10/1993 |
| JP | 2000-154785 | A | 6/2000 |
| JP | 2002-089459 | A | 3/2002 |
| JP | 2008-202496 | A | 9/2008 |
| JP | 2013-185476 | A | 9/2013 |
| JP | 2014-105607 | A | 6/2014 |
| WO | 2014-053858 | A1 | 4/2014 |

OTHER PUBLICATIONS

Written Opinion dated Jun. 28, 2016 for corresponding International Application No. PCT/JP2016/060760.

English Translation for Written Opinion dated Jun. 28, 2016 for corresponding International Application No. PCT/JP2016/060760.

Chinese Office Action dated Aug. 1, 2018 for corresponding Chinese Application No. 201680017345.5 and English translation.

* cited by examiner

PERISTALTIC PUMP HAVING ADJUSTABLE ROLLER GUIDING PARTS

CROSS-REFERENCE TO RELATED APPLICATION

This application is a continuation of PCT international application Ser. No. PCT/JP2016/060760 filed on Mar. 31, 2016 which designates the United States, and which claims the benefit of priority from Japanese Patent Application No. 2015-072775, filed on Mar. 31, 2015; the entire contents of which are incorporated herein by reference.

BACKGROUND OF THE INVENTION

1. Field of the Invention

The present invention relates to a rotor and a pump device.

2. Description of the Related Art

Conventionally, there has been used a pump device that sends liquid by causing a roller to revolve while depressing a tube arranged along an arcuate inner peripheral face formed in a housing. The pump device is, for example, provided with a housing, a tube arranged in the housing, a motor that rotates a drive shaft, and a rotor having a roller that revolves around the drive shaft as the drive shaft rotates to depress the tube.

Patent literature 1 (Japanese Patent Application Laid-open No. 2014-105607) discloses a pump device including a pump base that holds a rotor having a roller, and a motor; a housing that holds a tube arranged along an arcuate inner peripheral face; and a variable mechanism that changes a relative position between the pump base and the housing. In the pump device described in patent literature 1, the variable mechanism changes the relative position between the pump base and the housing to move the position of the rotor thus achieving the easy attachment/detachment of the tube.

Here, as a tube arranged in the housing of the pump device, various tubes having various kinds of outside diameters and inside diameters are used depending on the intended amount of sending liquid, or the like. Accordingly, it is necessary to adjust the amount of depressing the tube by changing the position of the roller depending on the outside diameter and the inside diameter of the tube.

In the pump device described in patent literature 1, the position of the rotor can be changed. However, it is difficult to adjust the amount of depressing the tube by changing the position of the roller.

The present invention has been made under such circumferences, and it is an object of the present invention to provide a rotor capable of adjusting the amount of depressing the tube by changing the position of the roller, and a pump device.

SUMMARY OF THE INVENTION

To solve the above problems and to achieve the object, a rotor according to one aspect of the invention is a rotor configured to depress a tube so as to send liquid in the tube, and includes a rotary body configured to rotate about a rotational shaft; a plurality of bottom parts attached to the rotary body; a plurality of arm parts including respective rollers configured to revolve around the rotational shaft and depress the tube, the arm parts being attached to the respective bottom parts; and an adjuster configured to adjust a mutual positional relation between the bottom parts in a radial direction of the rotation of the rotary body.

DESCRIPTION OF EMBODIMENTS

Detailed Description of the Preferred Embodiments

Figure 1:
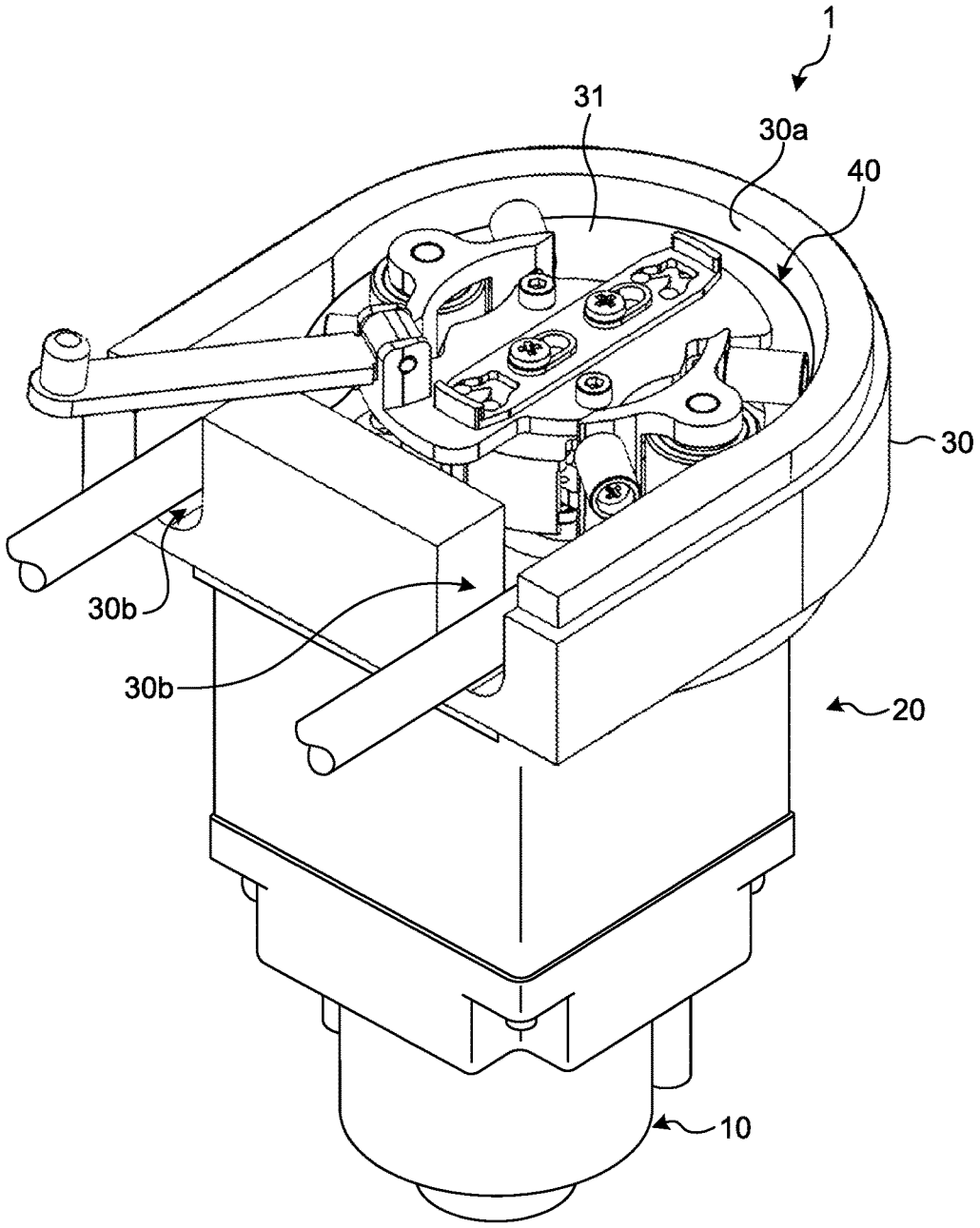
FIG. 1 is a schematic perspective view illustrating an essential part of a pump device according to a first embodiment of the present invention.

A rotor according to one aspect of the invention is a rotor configured to depress a tube so as to send liquid in the tube, and includes a rotary body configured to rotate about a rotational shaft; a plurality of bottom parts attached to the rotary body; a plurality of arm parts including respective rollers configured to revolve around the rotational shaft and depress the tube, the arm parts being attached to the respective bottom parts; and a position adjusting means configured to adjust a mutual positional relation between the bottom parts in a radial direction of the rotation of the rotary body.

Furthermore, in the rotor according to one aspect of the invention, the position adjusting means adjusts a distance from each of the bottom parts to the rotational shaft in the bottom part.

Furthermore, in the rotor according to one aspect of the invention, the position adjusting means includes a cam mechanism capable of defining a plurality of positional relations in the bottom parts.

Furthermore, in the rotor according to one aspect of the invention, the bottom parts are arranged around the rotational shaft, the cam mechanism includes a projection portion formed in each of the bottom parts, and a cam operation part capable of moving relative to the bottom parts, and the cam operation part has an elongated hole extending in a direction intersecting with an operation direction of the cam operation part, the projection portion being inserted into the elongated hole, the projection portion being guided by the elongated hole.

Furthermore, in the rotor according to one aspect of the invention, the rollers are arranged in a rotation symmetric manner with respect to the rotational shaft.

Furthermore, in the rotor according to one aspect of the invention, in the cam mechanism, the elongated hole includes at least one operation-direction extending portion extending along an operation direction of the cam operation part.

Furthermore, in the rotor according to one aspect of the invention, the cam mechanism is capable of adjusting a position of the projection portion guided by the elongated hole in a stepless manner.

Furthermore, the rotor according to one aspect of the invention further includes a fine adjustment mechanism configured to finely adjust a position of the cam operation part.

Furthermore, in the rotor according to one aspect of the invention, two bottom parts out of the bottom parts are arranged facing each other in an opposed manner with respect to the rotational shaft interposed between the two bottom parts.

Furthermore, in the rotor according to one aspect of the invention further includes a biasing means configured to bias the roller to radially outside of the rotation of the rotary body.

Furthermore, in the rotor according to one aspect of the invention further includes a guide means configured to enable the movement of the arm parts relative to the bottom parts.

Furthermore, a pump device according to one aspect of the invention includes a housing configured to house the rotor and the tube; the rotor according to any one aspects of the invention; and a motor configured to function as a driving source of the rotation of the rotor.

Hereinafter, with reference to attached drawings, the embodiments of a rotor and a pump device according to the present invention are explained in detail. Here, the present invention is not limited to the following embodiments. Furthermore, in the drawings, constitutional features having identical functions or corresponding to each other are properly given same numerals, and their repeated explanations are properly omitted.

First Embodiment

Figure 2:
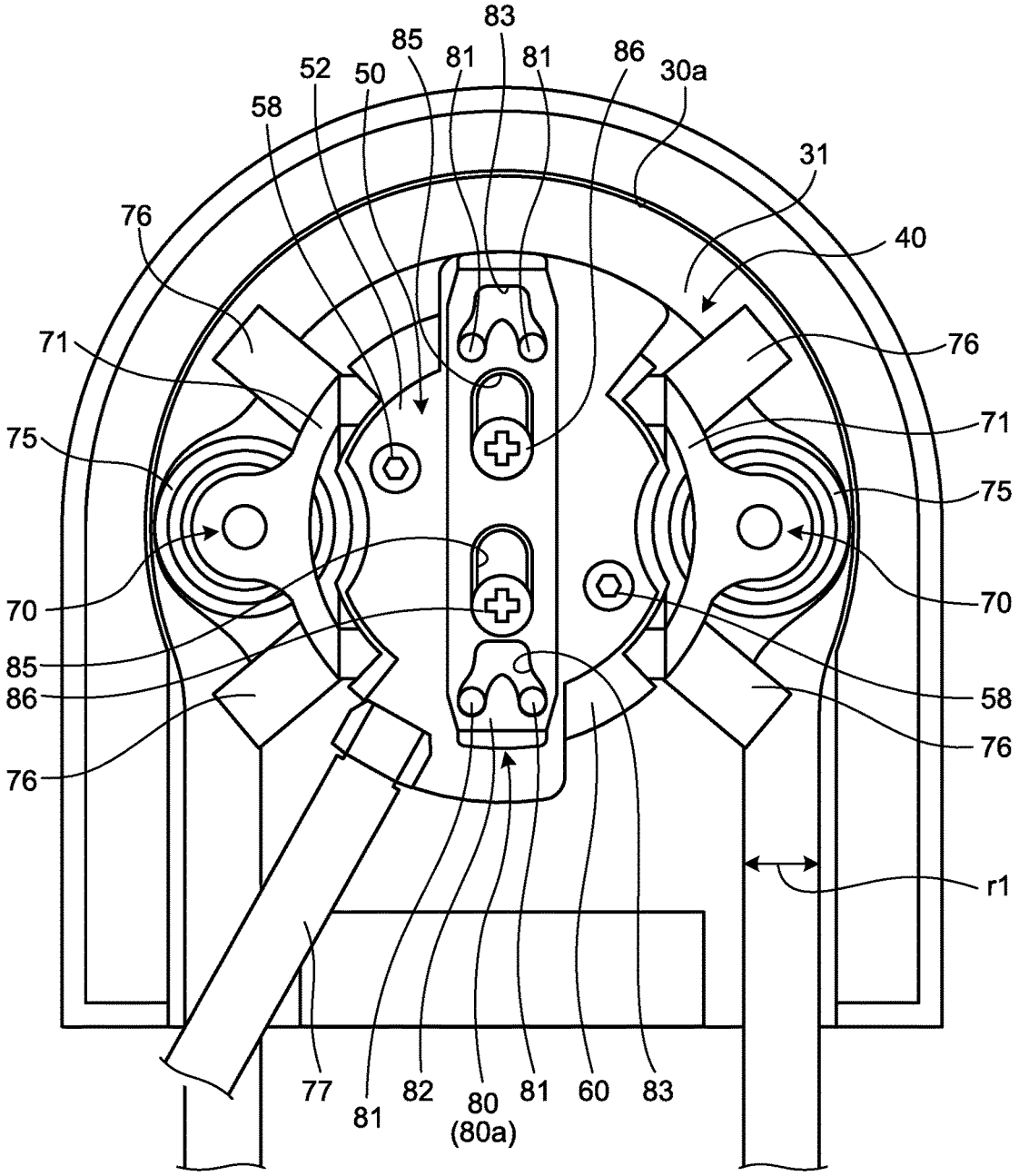
FIG. 2 is a schematic explanatory view of a rotor included in the pump device according to the first embodiment of the present invention, as viewed from the front face side of the rotor.
Figure 3:
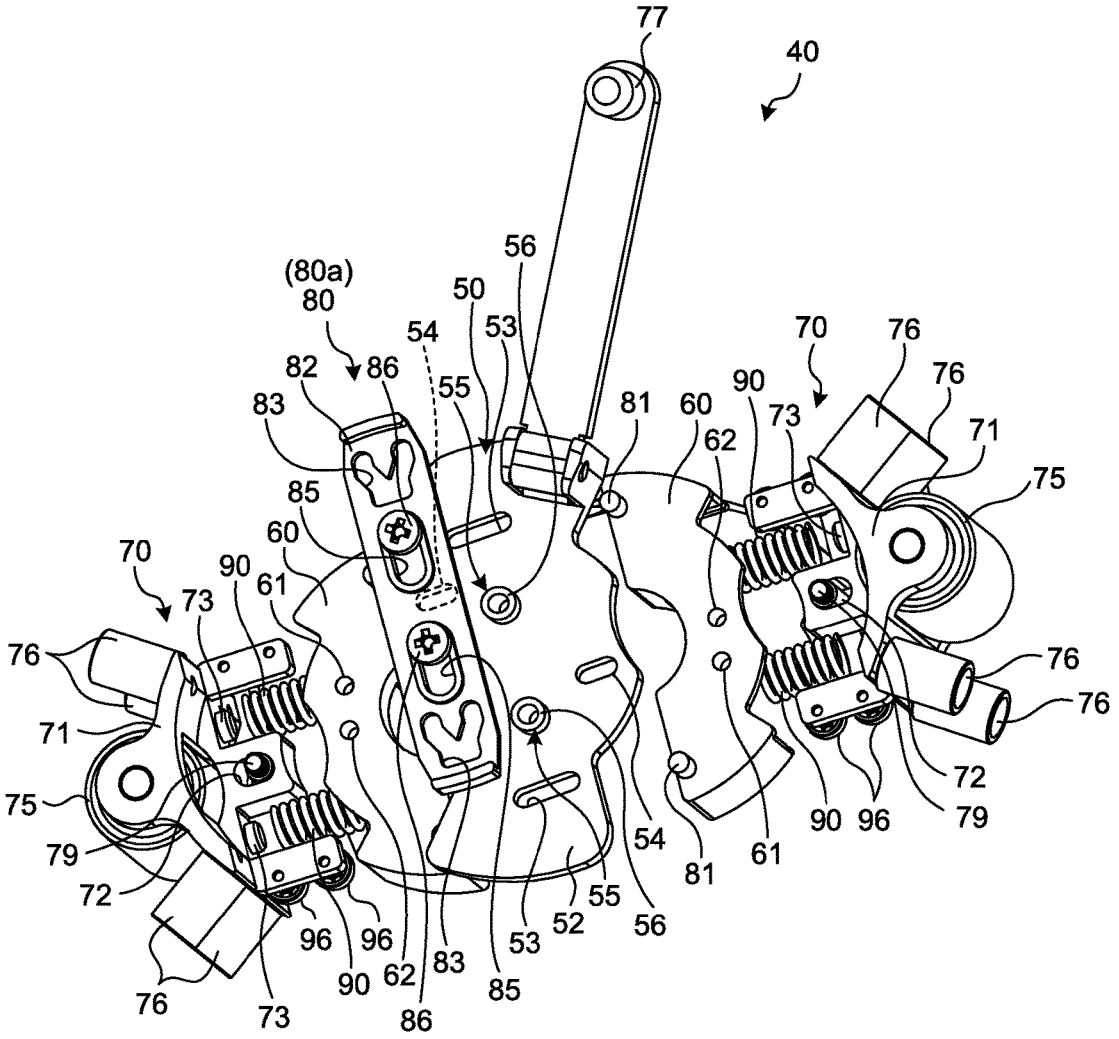
FIG. 3 is an exploded perspective view of the rotor included in the pump device according to the first embodiment of the present invention, as viewed from the front face side of the rotor.
Figure 4:
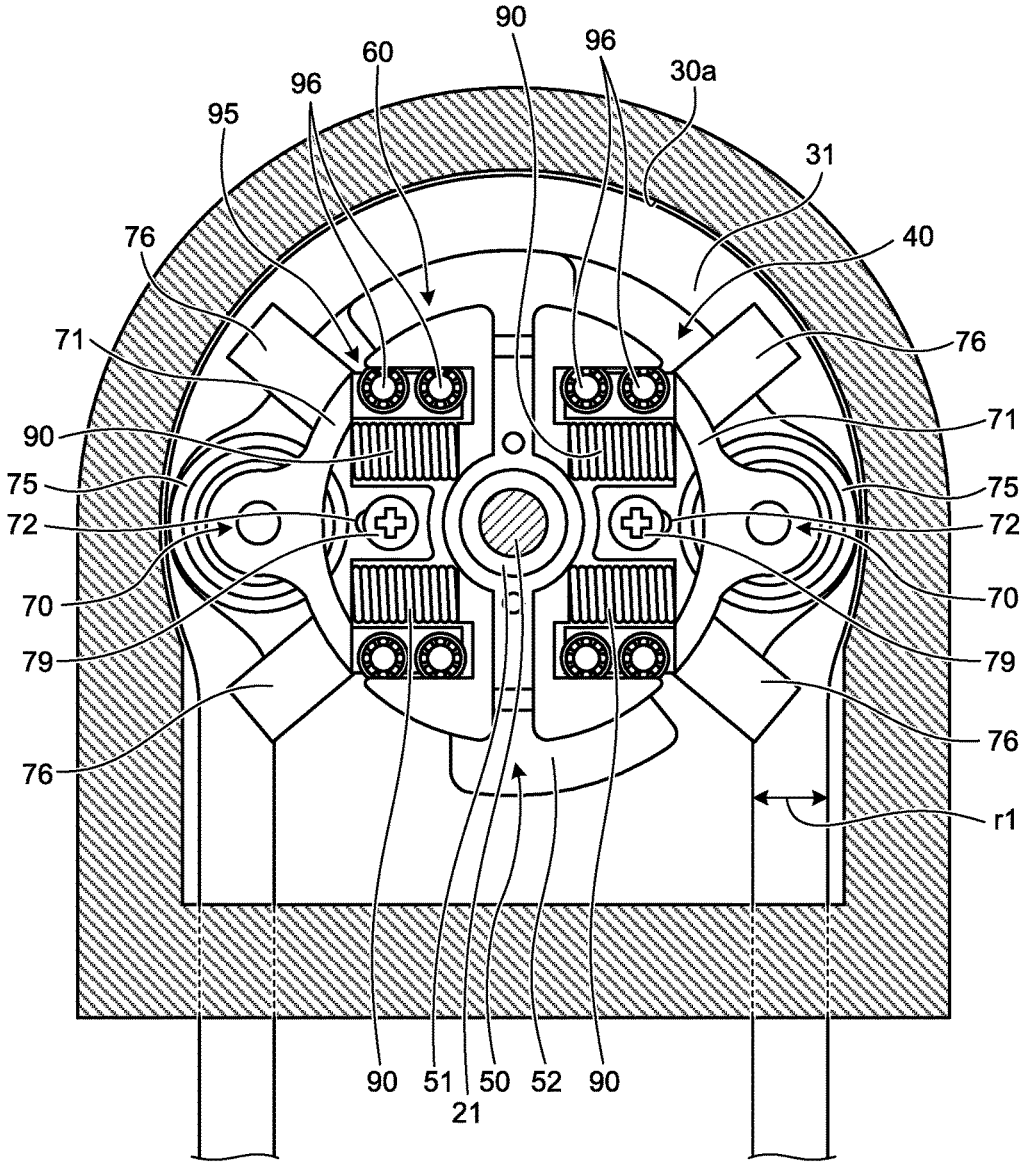
FIG. 4 is a schematic explanatory view of the rotor included in the pump device according to the first embodiment of the present invention, as viewed from the rear face side of the rotor.
Figure 5:
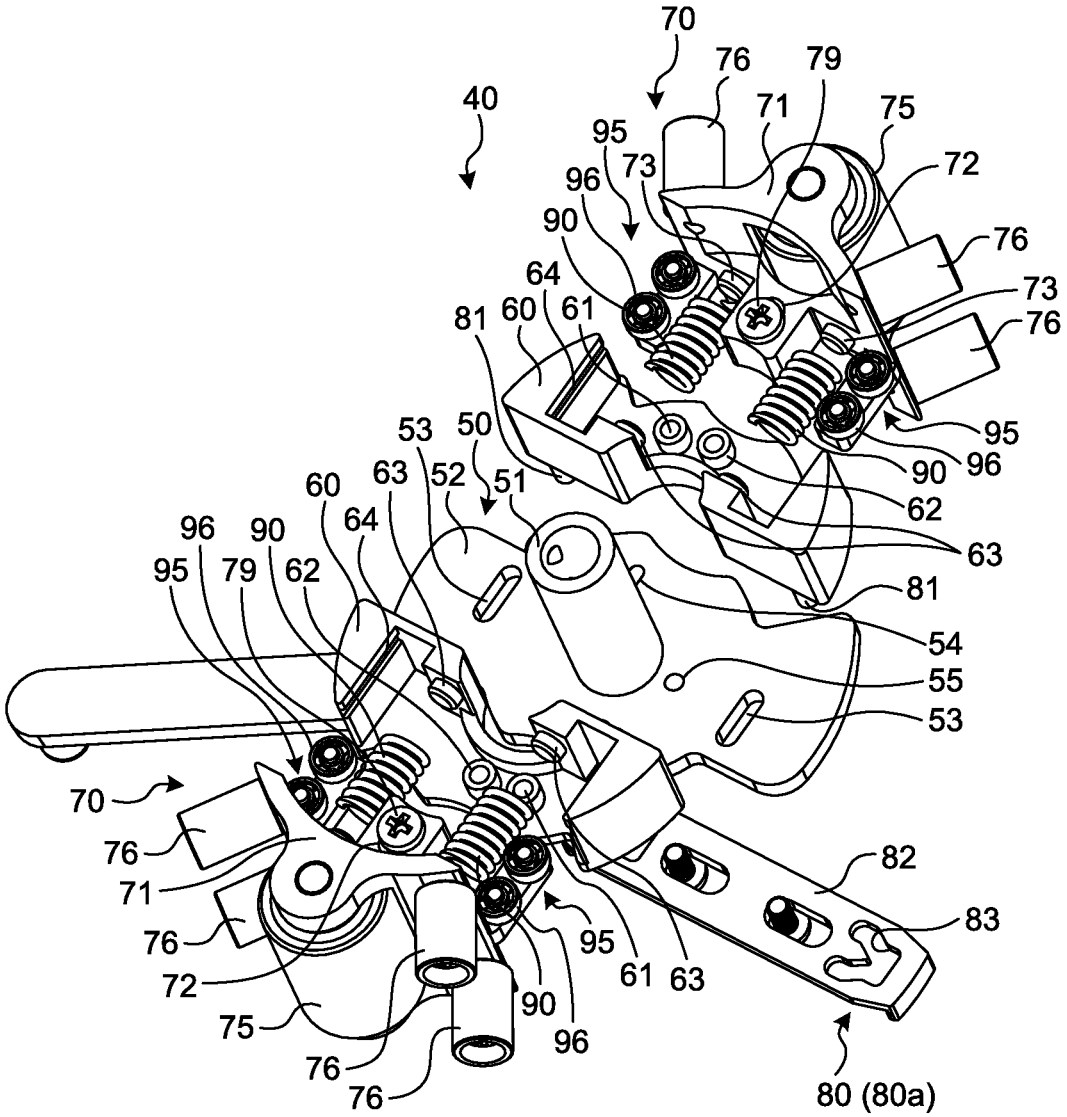
FIG. 5 is an exploded perspective view of the rotor included in the pump device according to the first embodiment of the present invention, as viewed from the rear face side of the rotor.

First of all, the explanation is made with respect to a pump device 1 and a rotor 40 according to a first embodiment of the present invention. FIG. 1 is a schematic perspective view illustrating an essential part of the pump device 1 according to the first embodiment of the present invention. Here, FIG. 1 illustrates the pump device 1 in a state that a top cover of a housing 30 is removed. FIG. 2 is a schematic explanatory view of the rotor 40 included in the pump device 1 according to the first embodiment of the present invention, as viewed from the front face side of the rotor 40. Here, in the present embodiment, as viewed from the rotor 40, a side of the pump device 1 on which the top cover of the housing 30 is attached is referred to as "front face side", and a side of the pump device 1 on which a reduction gear 20 is attached is referred to as "rear face side". FIG. 3 is an exploded perspective view of the rotor 40 included in the pump device 1 according to the first embodiment of the present invention, as viewed from the front face side of the pump device 1. FIG. 4 is a schematic explanatory view of the rotor 40 included in the pump device 1 according to the first embodiment of the present invention, as viewed from the rear face side of the pump device 1. FIG. 5 is an exploded perspective view of the rotor 40 included in the pump device 1 according to the first embodiment of the present invention, as viewed from the rear face side of the pump device 1.

The pump device 1 according to the first embodiment of the present invention includes a motor 10, the reduction gear 20, the housing 30, and the rotor 40 housed in the housing 30. The pump device 1 is a pump (tube pump) that depresses a tube 31 filled with liquid with the use of the rotor 40 to send the liquid in a predetermined direction. To be more specific, the liquid is blood, and the pump device 1 is used for artificial dialysis or the like.

The motor 10 is a driving source that gives a rotational driving force to the rotor 40 by way of the reduction gear 20, and is driven by electric power supplied from a battery, an external power source, or the like depending on instructions from a control circuit. The reduction gear 20 is connected with a rotational shaft 21 of the motor 10.

The reduction gear 20 is a device that decelerates a rotational speed of an input-side power source to output the decelerated rotational speed, and decelerates a rotation from the output shaft of the motor 10 to output the decelerated rotation to the rotational shaft 21 (output shaft) of the reduction gears 20.

Here, applicable examples of the motor 10 include a DC motor, a brushless DC motor, and a stepping motor, and the type of the motor 10 is not limited in particular. Furthermore, when the stepping motor is used, a reduction gear may become unnecessary.

The housing 30 has therein a space for housing the tube 31 and the rotor 40. The housing 30 has an internal peripheral wall surface 30*a* formed in an arcuate shape, and forms therein a recessed portion 30*b* for guiding the tube 31 to the outside thereof. The tube 31 is arranged along the internal peripheral wall surface 30*a*, and extends outward through the recessed portion 30*b*. A through hole is formed in the bottom surface side of the housing 30, and the rotational shaft 21 of the reduction gear 20 projects toward the inside of the housing 30.

The rotor 40 is attached to the rotational shaft 21 of the reduction gear 20, and rotates about the rotational shaft 21. That is, the rotational shaft 21 of the reduction gears 20 constitutes the axis of rotation of the rotor 40. The rotor 40 includes a rotary body 50, a plurality of bottom parts 60, a plurality of arm parts 70 having respective rollers 75, a position adjusting means 80, an elastic member 90, and a guide means 95 (see FIGS. 2 to 5).

The rotary body 50 has a holding part 51 that holds the rotational shaft 21, and a plate-like member 52 formed in a plate-like shape. The holding part 51 is formed in a cylindrical shape, and rotates integrally with the rotational shaft 21 about the rotational shaft 21. The plate-like member 52 forms therein two elongated holes 53 in such a manner that the elongated holes 53 sandwiches the rotational shaft 21 (holding part 51). The elongated hole 53 is formed in an extending manner in a direction parallel to the direction of a line connecting the axes of two rollers 75 arranged to face each other in an opposed manner.

The plate-like member 52 has therein two elongated holes 54 used for fixing the respective bottom parts 60 thereto with screws. The elongated holes 54 are each also formed in an extending manner in a direction parallel to the direction of a line connecting the axes of two rollers 75, and are formed in a symmetric manner with respect to the rotational shaft 21 (holding part 51) interposed therebetween. Furthermore, the plate-like member 52 forms therein a fixing part 55 for attaching a cam operation part 82 described below to the plate-like member 52.

The plurality of bottom parts 60 are arranged around the rotational shaft 21. In the first embodiment, the rotor 40 includes two bottom parts 60, which are arranged to face each other in an opposed manner with the rotational shaft 21 (holding part 51) interposed therebetween (see FIG. 4 and FIG. 5). Each of the bottom parts 60 forms therein two threaded holes 61 and 62. One threaded hole 61 is used for fixing the bottom part 60 to the rotary body 50, and a screw 58 is inserted into the elongated hole 54 formed in the plate-like member 52 of the rotary body 50 and, at the same time, threadedly engaged with the threaded hole 61 thus attaching the bottom part 60 to the rotary body 50. The other threaded hole 62 is used for attaching the bottom part 60 to the arm part 70.

The bottom part 60 forms two projection portions 81 on the front face side thereof. The projection portion 81 is formed on the side of one bottom part 60 that is close to the end of the other bottom part 60 arranged to face the one bottom part 60 in an opposed manner.

Each of the bottom parts 60 includes two projecting portions 63 for positioning the end of the elastic member 90 and two grooves 64 each of which is a part of the guide means 95, on the rear-face side thereof. The groove 64 is formed in an extending manner in a direction parallel to the direction of a line connecting the axes of two rollers 75 arranged to face each other in an opposed manner.

In each bottom part 60, the arm part 70 has an arm part body 71 attached to the radially outside of the rotation of the rotary body 50, and the roller 75 that is attached to the arm part body 71 and projects to the radially outside of the rotation of the rotary body 50. The arm part body 71 forms therein an elongated hole 72 extending along a line connecting the axes of the rollers 75. A screw 79 is inserted into the elongated hole 72 and, at the same time, the screw 79 is threadedly engaged with the threaded hole 62 of the bottom part 60. The arm part 70 is thus attached to the bottom part 60. Here, a sleeve is interposed between the elongated hole 72 and the screw 79 thus improving the slidability of the arm part 70 with respect to the bottom part 60 and, at the same time, preventing the backlash of the arm part 70 described below with respect to the bottom part 60 when the arm part 70 is moved relative to the bottom part 60.

Furthermore, the arm part body 71 forms therein a projecting portion 73 for positioning the end of the elastic member 90, and attaches a bearing 96 thereto. The elastic member 90 is interposed between the bottom part 60 and the arm part 70, and the arm part 70 is fixed to the bottom part 60 with the screw 79.

The roller 75 is attached to the arm part body 71 in a rotatable manner about the axis of the roller 75. The rollers 75 are arranged in a symmetric manner with respect to the rotational shaft 21, wherein the rotational shaft 21, two bottom parts 60, two arm part bodies 71, and two rollers 75 are arranged in line. That is, the revolution axis of the roller 75 and the rotation axes of two rollers 75 are arranged in line, and the roller 75 is configured to depress the tube 31 in a direction perpendicular to the direction where the tube 31 extends.

Here, the rotary body 50 rotates integrally with the rotational shaft 21, and the bottom part 60 attached to the rotary body 50 also rotates integrally with the rotary body 50. In addition, the arm part body 71 attached to the bottom part 60 also rotates integrally with the rotary body 50. Accordingly, the roller 75 attached to the arm part body 71 also rotates integrally with the rotary body 50. Due to such a constitution, the roller 75 revolves around the rotational shaft 21. The roller 75 revolves around the rotational shaft 21 so as to depress the tube 31 arranged on the internal peripheral wall surface 30*a* of the housing 30 thus sending the liquid in the tube 31 in the direction where the roller 75 revolves around the rotational shaft 21.

The guide means 95 enables the movement of the bottom part 60 relative to the arm part 70. To be more specific, the guide means 95 is constituted of the groove 64 formed in the bottom part 60, and the bearing 96 inserted into the groove 64. When the arm part 70 is moved relative to the bottom part 60 in the radial direction (horizontal direction in FIG. 4) of the rotation of the rotary body 50, the bearing 96 is rolled along the groove 64 formed in the bottom part 60 to guide the movement of the arm part 70. In the first embodiment, the groove 64 extends in the direction of a line connecting the axes of two rollers 75 thus changing the position of the roller 75 in the radial direction of the rotation of the rotary body 50 by the distance by which the arm part 70 guided by the guide means 95 is moved.

Here, the guide means 95 is not limited to the case that the guide means 95 is constituted of the groove 64 and the bearing 96. For example, the following case may be applicable; that is, a guide means has a projecting portion formed in the arm part 70, and the projecting portion engaged with a groove formed in the bottom part 60 thus guiding the movement of the arm part 70 relative to the bottom part 60.

Furthermore, in the arm part 70, tube guides 76 that restrict the movement of the tube 31 in the vertical direction are arranged on the radially outside of the rotation of the rotary body 50.

The elastic member 90 is used for pushing the arm part 70 to the radially outside of the rotation of rotary body 50, and arranged between the projecting portion 63 of the bottom part 60 and the projecting portion 73 of the arm part 70. Two elastic members 90 are provided to each of the bottom parts 60. The arm part 70 is attached to the bottom part 60 in a state that the arm part 70 and the bottom part 60 are spring-biased to each other with the use of the elastic member 90. The direction in which the arm part 70 and the bottom part 60 are spring-biased to each other with the use of the elastic member 90 is the direction of a line connecting the axes of two rollers 75 arranged to face each other in an opposed manner.

The position adjusting means 80 is used for adjusting a mutual positional relation between the plurality of bottom parts 60. In the first embodiment, the position adjusting means 80 adjusts the mutual positional relation between two bottom parts 60 arranged to face each other in an opposed manner as described above. To be more specific, the position adjusting means 80 adjusts a distance from the bottom part 60 to the rotational shaft 21 in each of the bottom parts 60. The position adjusting means 80 has a cam mechanism 80*a* capable of specifying a plurality of positional relations in the plurality of bottom parts 60.

The cam mechanism 80*a* includes a projection portion 81 formed in each of the bottom parts 60, and a cam operation part 82 (cam lever) capable of moving relative to the bottom part 60. The cam operation part 82 forms therein a slide groove 85 extending in the direction orthogonal to the direction of a line connecting the axes of two rollers 75 arranged to face each other in an opposed manner. The fixing part 55 has a peripheral wall portion 56 projecting from a surface of the plate-like member 52 in the vertical direction of the surface. The slide groove 85 is fitted onto the outer periphery of the peripheral wall portion 56. The peripheral wall portion 56 has a thread groove formed in the inner peripheral face side thereof. Furthermore, a screw 86 is inserted into the slide groove 85 and, at the same time, the screw 86 is fixed to the fixing part 55 of the rotary body 50. The screw 86 attaches the cam operation part 82 to the rotary body 50 in such a manner that the cam operation part 82 is capable of moving relative to the rotary body 50 in the longitudinal direction of the slide groove 85. Here, the peripheral wall portion 56 improves slidability between the cam operation part 82 and the rotary body 50 thus preventing the backlash of the cam operation part 82 when the cam operation part 82 is moved.

The cam operation part 82 forms therein an elongated hole 83 extending in a direction intersecting with the moving direction (vertical direction in FIG. 2) of the cam operation part 82. The projection portion 81 is inserted into the elongated hole 83. In the first embodiment, the elongated hole 83 is formed in a V-shape, and slightly bent in the longitudinal direction (extending direction) of the elongated hole 83. The cam mechanism 80*a* adjusts the distance between the bottom part 60 and the rotational shaft 21, thereby adjusting the position of the roller 75.

Here, in the first embodiment, the rotor 40 has a manual rotating operation lever 77 for rotating the rotor 40 manually. The manual rotating operation lever 77 is operated by hand to rotate the rotor 40 thus achieving easy attachment and detachment of the tube 31.

Figure 6:
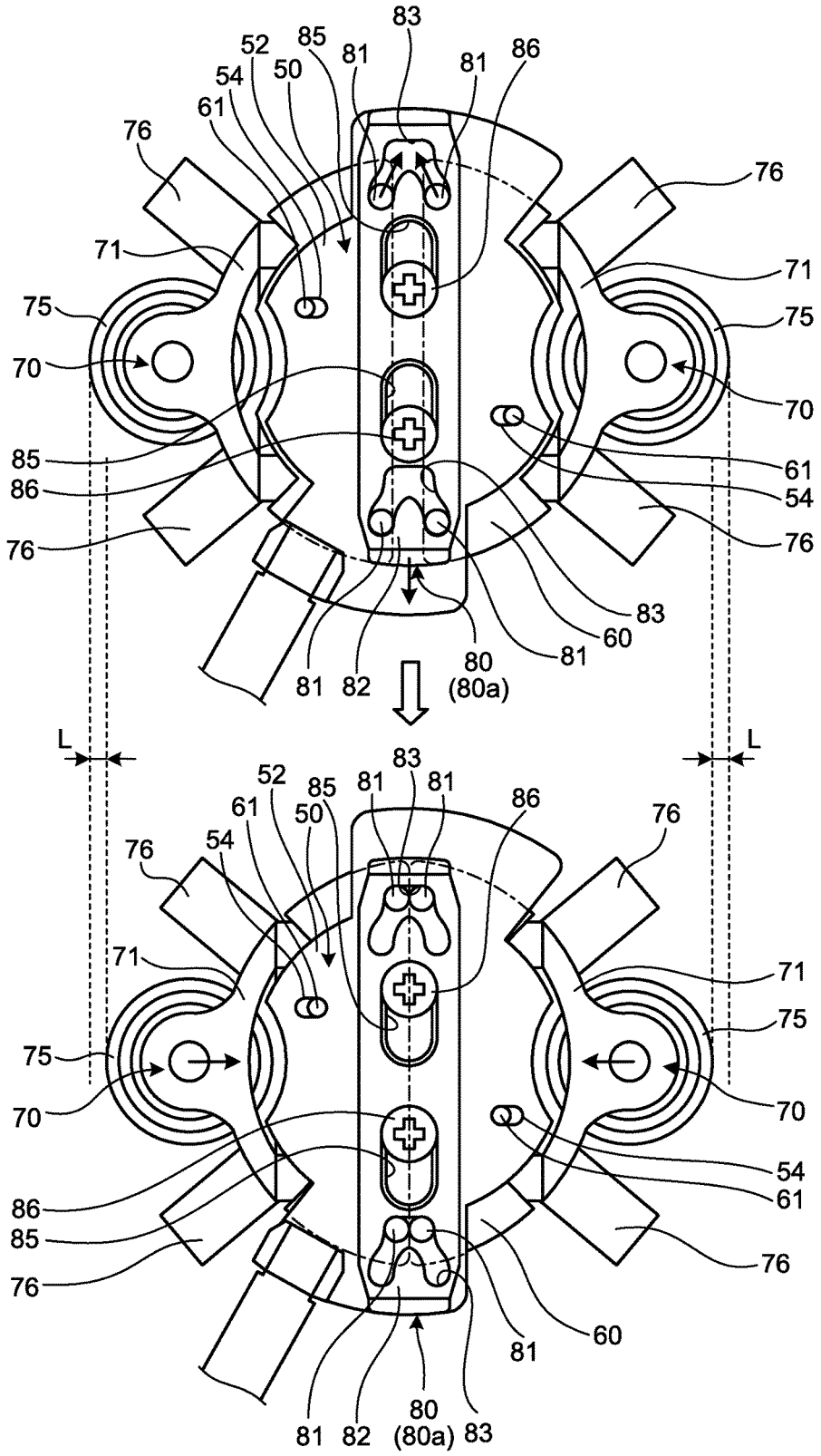
FIG. 6 is a schematic explanatory view for explaining the operation of a cam mechanism included in the pump device according to the first embodiment of the present invention.
Figure 7:
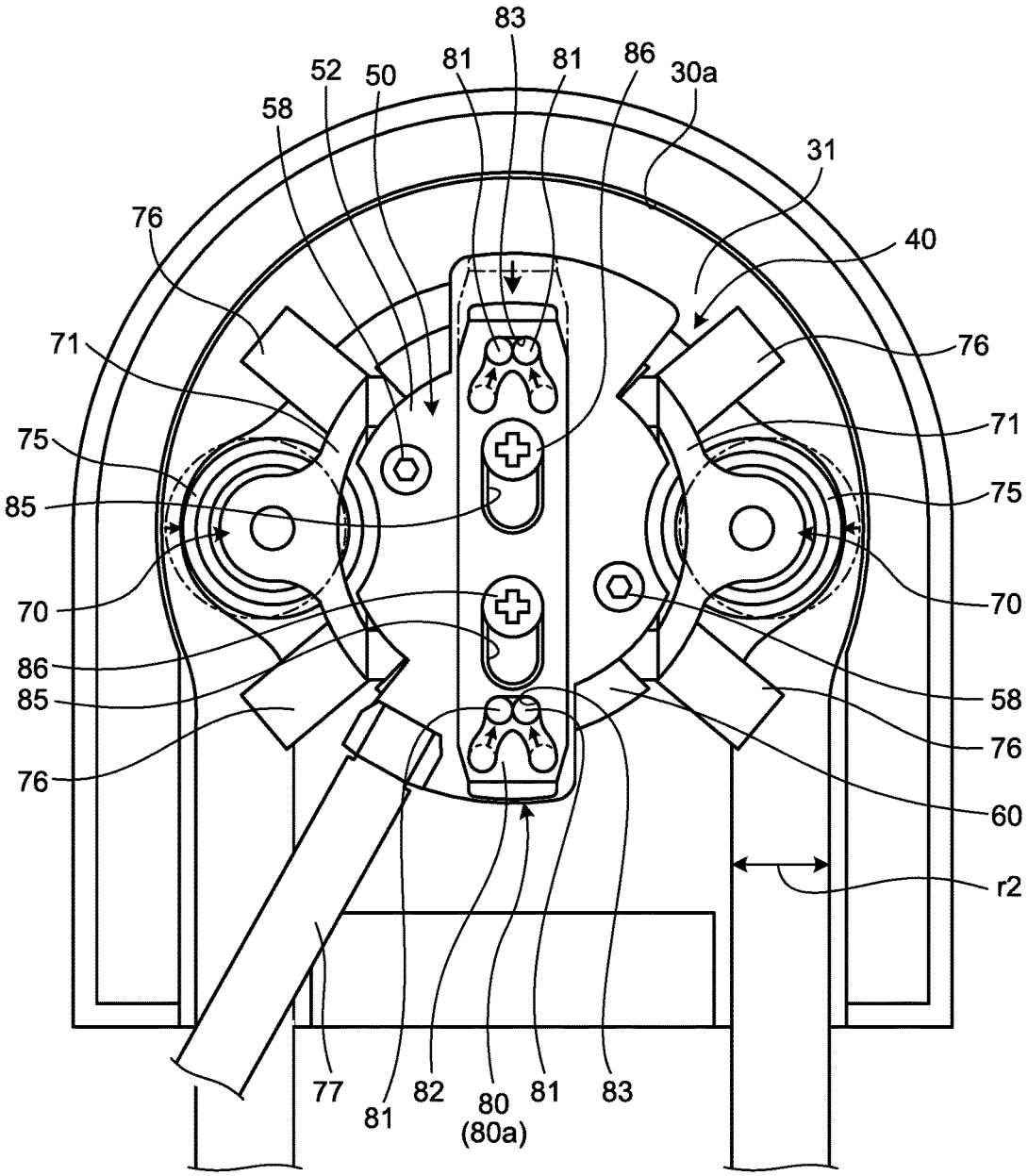
FIG. 7 is a schematic explanatory view for explaining the state of the rotor after a cam operation part included in the pump device according to the first embodiment of the present invention is moved.

Next, the explanation is made with respect to the manner of operation when the cam operation part 82 is operated in the pump device 1 according to the first embodiment. FIG. 6 is a schematic explanatory view for explaining the operation of the cam mechanism 80*a* included in the pump device 1 according to the first embodiment of the present invention. Here, in FIG. 6, portions of the bottom part 60 that are hidden by other members are indicated by dashed dotted lines. FIG. 7 is a schematic explanatory view for explaining the state of the rotor 40 after the cam operation part 82 included in the pump device 1 according to the first embodiment of the present invention is moved from the state illustrated in FIG. 2. Here, dashed lines illustrated in FIG. 7 indicate a part of the rotor 40 in a state before the cam operation part 82 is moved.

As illustrated in FIG. 6, when the cam operation part 82 is downwardly moved, the projection portion 81 is guided by the elongated hole 83, and the bottom part 60 is moved to the radially inner side of the rotation of the rotary body 50. Here, the cam operation part 82 is moved in a state that the screw 58 is loosened. Since the elongated hole 54 is formed in the plate-like member 52, even when the bottom part 60 is moved, it is possible to attach the bottom part 60 to the rotary body 50 with the screw 58.

Here, the longitudinal direction of the elongated hole 83 of the cam operation part 82 is a direction intersecting with the moving direction of the cam operation part 82 and hence, the projection portion 81 is moved along the elongated hole 83 thus changing the distance between the bottom parts 60. Due to such a constitution, when the bottom part 60 is moved to the radially inner side of the rotation of the rotary body 50, the roller 75 is also moved to the radially inner side of the rotation of the rotary body 50.

When the cam operation part 82 is, as mentioned above, downwardly moved, the projection portion 81 is moved in the direction of a line connecting the axes of two rollers 75 (horizontal direction in FIGS. 6 and 7), and the roller 75 is inwardly moved by the distance where the projection portion 81 is moved (see FIGS. 6 and 7). To be more specific, the roller 75 is inwardly moved by the distance L illustrated in FIG. 6.

For example, when the tube 31 has a small diameter (diameter: r1), it is possible to set the roller 75 at the position of the roller 75 illustrated in FIG. 2, and when the tube 31 has a large diameter (diameter: r2), it is possible to set the roller 75 at the position of the roller 75 illustrated in FIG. 7.

After the cam operation part 82 is moved, the screw 58 is inserted into the elongated hole 53, and threadedly engaged with the threaded hole 61. The bottom part 60 is thus fixed to the rotary body 50.

Here, since the arm part 70 is attached to the bottom part 60 with the screw 79, even when the cam operation part 82 is operated as mentioned above to adjusts the position of the roller 75, the depressing force of the elastic member 90 remains unchanged.

According to the first embodiment of the present invention, the pump device 1 and the rotor 40 configured as described above enable the cam operation part 82 to be operated, thereby adjusting the distance from the rotational shaft 21 to each of the bottom parts 60 and changing the position of the roller 75. Due to such a constitution, even when the inside diameter and the outside diameter of the tube 31 used are changed, operating the cam operation part 82 can easily adjust the position of the roller 75 to an intended position, and can adjust the amount of depressing the tube. That is, simply adjusting the position of the roller 75 provides an appropriate depressing force to the tube 31.

Here, when the depressing force of the roller is insufficient compared with an appropriate value, it is impossible to securely send the liquid in the tube in a uniform direction. Furthermore, an excessive depressing force to the tube that is larger than the appropriate value may accelerate deterioration of the tube. Accordingly, the rotor 40 and the pump device 1 configured as described above adjust the position of the roller 75 so that the depressing force of the roller 75 with respect to the tube 31 becomes an appropriate depressing force.

Furthermore, the pump device 1 and the rotor 40 can simultaneously adjust the plurality of rollers 75, and this can reduce time and efforts required for adjustment.

In addition, in the case of the constitution where the rollers are individually adjusted, variation may occur in adjustment of the position of each of the rollers. By contrast, the rotor 40 according to the first embodiment enables the cam operation part 82 to be operated, and the positions of the plurality of rollers 75 are simultaneously determined by the position of the projection portion 81 in the elongated hole 83, thus preventing the variation in adjustment of the position of each of the rollers.

The elastic member 90 is arranged between the bottom part 60 and the arm part 70, thus absorbing the variation in thickness (outside diameter and inside diameter) of the tube 31 and the variation in dimension of the internal peripheral wall surface 30*a* of the housing 30.

Furthermore, the rotor 40 includes the guide means 95 that enables the movement of the arm part 70 relative to the bottom part 60 with the use of the elastic member 90, thus more precisely moving the roller 75 in the direction of a line connecting the rollers 75 arranged to face each other in an opposed manner.

Furthermore, the rollers 75 are arranged in a symmetric manner with respect to the rotational shaft 21, and biased perpendicularly to the direction in which the tube 31 extends. Thus a force given to the rotor 40 from the tube 31 side is not changed even when the rotor 40 rotates in the forward direction or in the reverse direction, and a torque required for rotating the rotor 40 is not changed even when the rotor 40 rotates in the forward direction or in the reverse direction.

Furthermore, the respective constitutions of two bottom parts 60 (two arm parts 70) are identical with each other thus reducing a manufacturing cost.

First modification of cam operation part

Figure 8A:
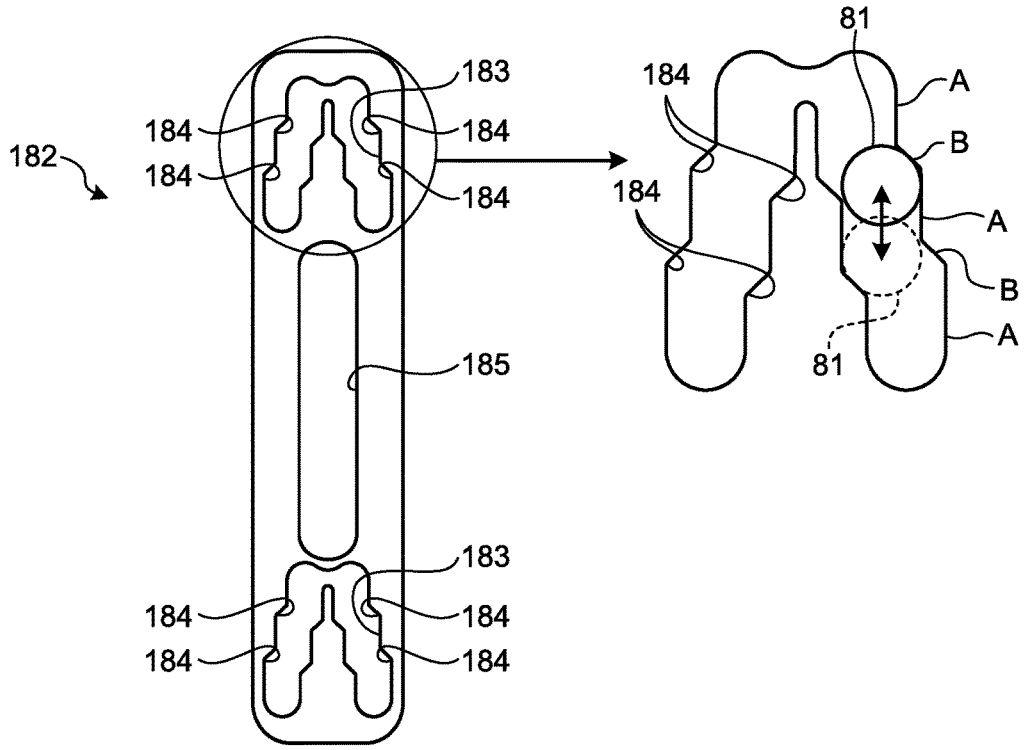
FIG. 8A is a view illustrating a first modification of the cam operation part of a cam mechanism included in the pump device according to the first embodiment of the present invention.

Next, the explanation is made with respect to the first modification of the cam operation part 82 of the cam mechanism 80*a* included in the pump device 1 according to the first embodiment of the present invention. FIG. 8A is a view illustrating the first modification of the cam operation part 82 of the cam mechanism 80*a* included in the pump device 1 according to the first embodiment of the present invention.

As illustrated in FIG. 8A, a cam operation part 182 is different in the shape of the elongated hole from the cam operation part 82 mentioned above. An elongated hole 183 extends in a V-shaped manner as a whole, in which a parallel portion A (operation-direction extending portion) that extends in a direction parallel to the direction in which the cam operation part 182 is operated when attached to the rotary body 50 (vertical direction in FIG. 8A) and an intersection portion B that extends in a direction intersecting with the direction in which the cam operation part 182 is operated are alternately arranged next to each other. To be more specific, the elongated hole 183 forms therein three parallel portions A each of which extends in a direction parallel to the direction in which the cam operation part 182 is operated, and two intersection portions B each of which extends in a direction intersecting with the direction in which the cam operation part 182 is operated. The parallel portion A and the intersection portion B are alternately arranged next to each other. The elongated hole 183 configured as described above has, in the longitudinal direction of the elongated hole 183, two stepped portions 184 in the middle of the elongated hole 183 in the direction in which the elongated hole 183 extends.

In the cam operation part 182 configured as described above, the elongated hole 183 forms therein the parallel portion A that exists in a direction parallel to the direction in which the cam operation part 182 is operated. When the projection portion 81 is located in the parallel portion A, the position of the bottom part 60 remains unchanged even when the cam operation part 182 is moved. That is, when the cam operation part 182 is operated, the interval at which the roller 75 is located at an intended position becomes longer, thus giving a margin to the operation of the cam operation part 182. Furthermore, in the case of the cam operation part 182, the elongated hole 183 forms therein three parallel portions A each of which extends in parallel with the direction in which the cam operation part 182 is operated, thus adjusting the position of the roller 75 in three stages. The cam operation part 182 is, in particular, preferably used when a position to which the roller 75 is required to move is determined in advance.

Here, in the cam operation part 182, a groove 185 formed in the center portion in the longitudinal direction of the cam operation part 182 is a slide groove used when the cam operation part 182 is moved relative to the rotary body 50.

Second modification of cam operation part

Figure 8B:
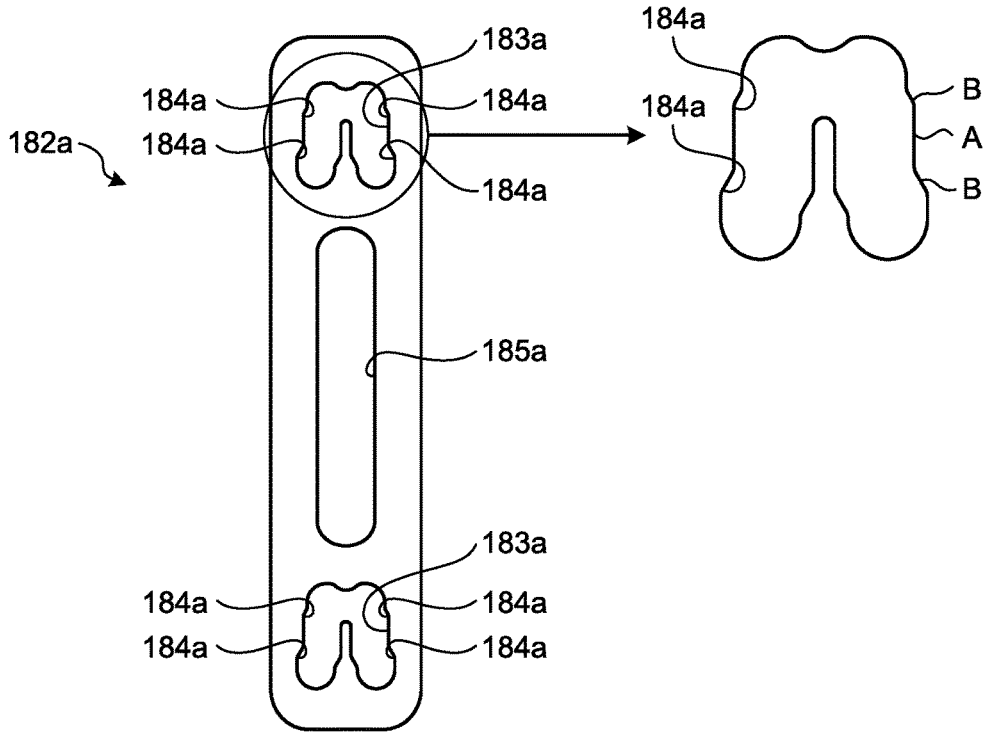
FIG. 8B is a view illustrating a second modification of the cam operation part of the cam mechanism included in the pump device according to the first embodiment of the present invention.

Next, the explanation is made with respect to the second modification of the cam operation part 82 of the cam mechanism 80*a* included in the pump device 1 according to the first embodiment of the present invention. FIG. 8B is a view illustrating the second modification of the cam operation part 82 of the cam mechanism 80*a* included in the pump device 1 according to the first embodiment of the present invention. In a cam operation part 182*a* illustrated in FIG. 8B, an elongated hole 183 is different in shape from the elongated hole 183 of the cam operation part 182. That is, the elongated hole 183*a* forms therein one parallel portion A (operation-direction extending portion) that extends in parallel with the direction in which the cam operation part 182*a* is operated, and two intersection portions B each of which extends in a direction intersecting with the direction in which the cam operation part 182*a* is operated. The elongated hole 183*a* includes two stepped portions 184*a* arranged on the outer periphery side thereof in the middle of the elongated hole 183*a* in the direction in which the elongated hole 183*a* extends. Here, in the cam operation part 182*a*, a groove 185*a* formed in the center portion in the longitudinal direction of the cam operation part 182*a* is a slide groove used when the cam operation part 182*a* is moved relative to the rotary body 50.

The cam operation part 182*a* configured as described above also achieves the same advantageous effects as those of the cam operation part 182, when the projection portion 81 is located in the parallel portion A that extends in parallel with the direction in which the cam operation part 182*a* is operated. Furthermore, in the cam operation part 182*a* also, it is possible to change the position of the roller 75 in three stages.

That is, the cam operation part, having the elongated hole extending in a direction intersecting with the direction in which the cam operation part is operated, includes the operation-direction extending portion extending in the same direction as the direction in which the cam operation part is operated at least in a middle portion of the elongated hole, thus enabling the position of a roller to be adjusted in a step-like manner.

Third modification of cam operation part

Figure 9:
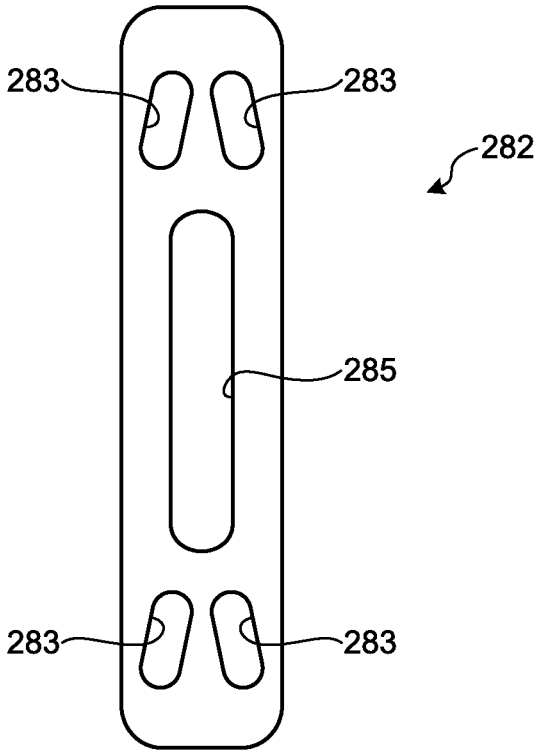
FIG. 9 is a view illustrating a third modification of the cam operation part of the cam mechanism included in the pump device according to the first embodiment of the present invention.

Next, the explanation is made with respect to the third modification of the cam operation part 82 of the cam mechanism 80*a* included in the pump device 1 according to the first embodiment of the present invention. FIG. 9 is a view illustrating the third modification of the cam operation part 82 of the cam mechanism 80*a* included in the pump device 1 according to the first embodiment of the present invention.

As illustrated in FIG. 9, two elongated holes 283 of a cam operation part 282 are formed in such a manner that the elongated holes 283 extend in the respective directions intersecting with each other, and formed in a spaced-apart manner. That is, two elongated holes 283 correspond to the elongated hole 83 mentioned above. In this case, the projection portion 81 formed on the front face side of the bottom part 60 may be arranged at a position corresponding to the position of the elongated hole 283 of the cam operation part 282. In the case of the cam operation part 82 mentioned above, two projection portions 81 are arranged in one elongated hole 83. On the other hand, in the case of the cam operation part 282, one projection portion 81 is arranged in each elongated hole 283.

Even when the cam operation part 282 including the elongated hole 283 is used, it is possible to achieve the same advantageous effects as the advantageous effects in the case of the cam operation part 82.

Here, in the cam operation part 282, a groove 285 formed in the center portion in the longitudinal direction of the cam operation part 282 is a slide groove used when the cam operation part 282 is moved relative to the rotary body 50.

First modification of cam mechanism

Figure 10:
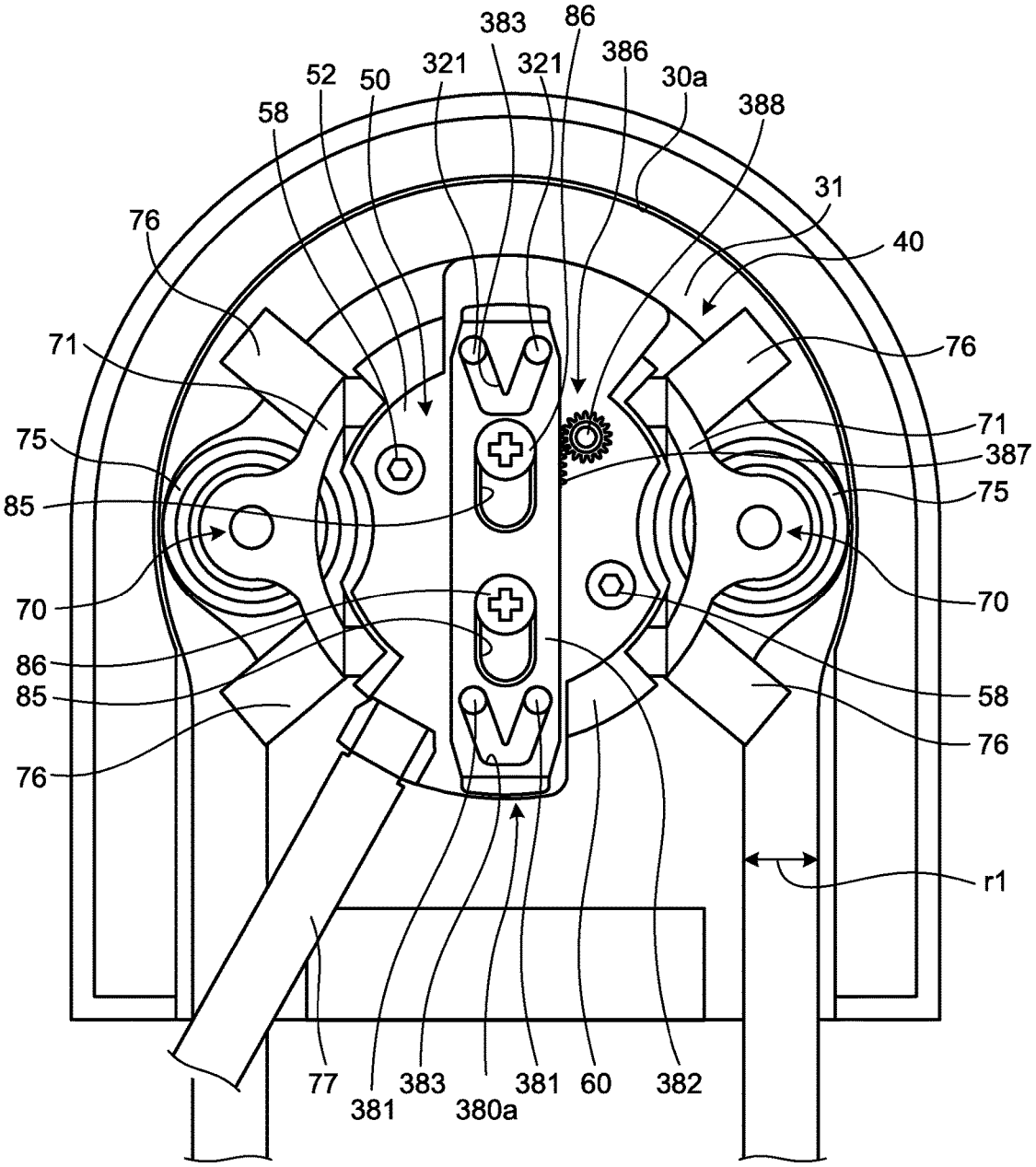
FIG. 10 is a view illustrating a first modification of the cam mechanism included in the pump device according to the first embodiment of the present invention.

Next, the explanation is made with respect to the first modification of the cam mechanism 80*a* included in the pump device 1 according to the first embodiment of the present invention. FIG. 10 is a view illustrating the first modification of the cam mechanism 80*a* included in the pump device 1 according to the first embodiment of the present invention. Here, constitutional features identical with those in the first embodiment mentioned above are given same numerals, and their detailed explanations are omitted.

A cam mechanism 380*a* includes a projection portion 381, a cam operation part 382, and a fine adjustment mechanism 386. The fine adjustment mechanism 386 constitutes a rack-and-pinion system, including a rack gear 387 on the side face of the cam operation part 382, and a pinion gear 388 is arranged on the front face side of the bottom part 60 so as to mesh with the rack gear 387.

In the cam operation part 82 mentioned above, although the elongated hole 83 is bent in the extending direction thereof, as illustrated in FIG. 10, the elongated hole 383 of the cam operation part 382 linearly extends in the extending direction of the elongated hole 383. In this manner, when the elongated hole is formed linearly, the projection portion 381 is stayed at an intended position in the direction in which the elongated hole 383 extends thus adjusting the position of the roller 75 in a stepless manner. Furthermore, the pinion gear 388 rotates, thus moving the cam operation part 382 by a predetermined distance, and finely adjusting the roller 75 to a predetermined position with higher accuracy.

Figure 11:
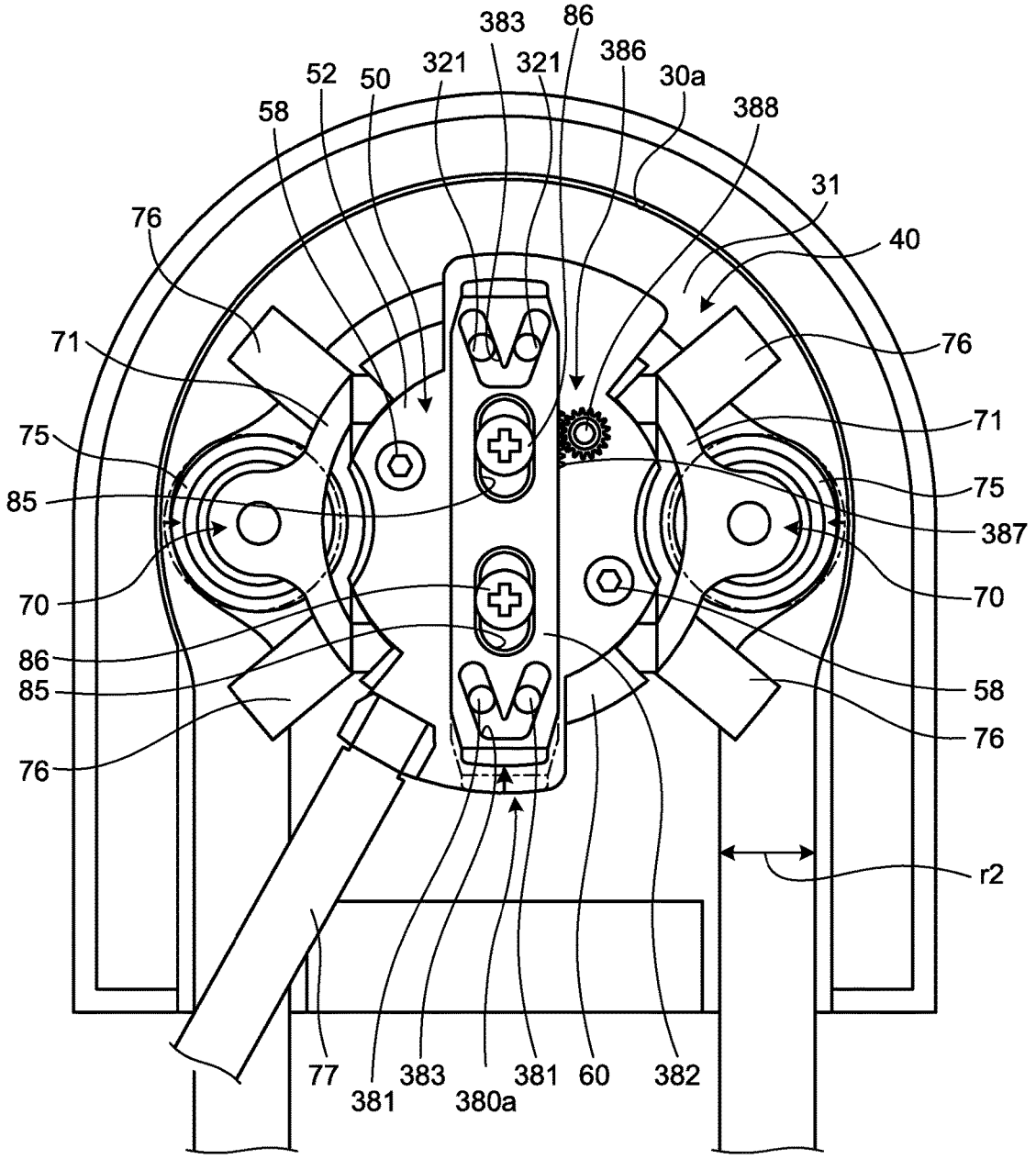
FIG. 11 is a schematic view for explaining the operation of the cam mechanism in the first modification.

FIG. 11 is a schematic view for explaining an operation when the cam operation part 382 is moved in the first modification of the cam mechanism 80*a* included in the pump device 1 according to the first embodiment of the present invention. In the cam mechanism 380*a*, the pinion gear 388 rotates to move the cam operation part 382 to a predetermined position, thus adjusting the roller 75 to an intended position, as illustrated in FIG. 11.

Second embodiment

Figure 12:
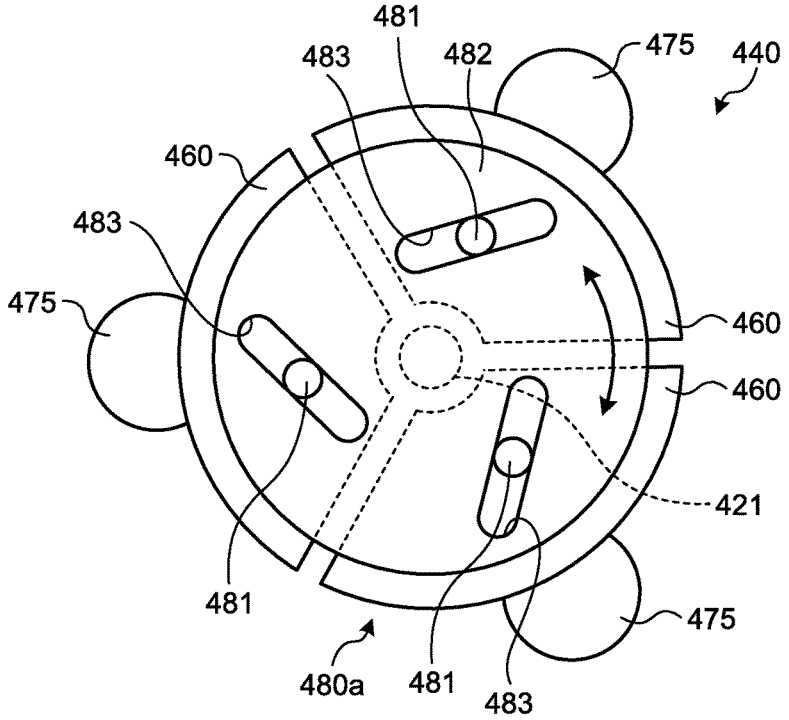
FIG. 12 is a conceptual explanatory view of a rotor according to a second embodiment of the present invention.

Next, a rotor 440 according to a second embodiment of the present invention is explained. FIG. 12 is a conceptual explanatory view illustrating the rotor 440 according to the second embodiment of the present invention. The second embodiment provides a configuration adaptable to the rotor in which three or more rollers are used.

The rotor 440 includes three bottom parts 460 arranged around a rotational shaft 421 in turn, rollers 475, and a cam mechanisms 480*a*. The cam mechanism 480*a* includes projection portions 481 and a cam operation part 482.

The cam operation part 482 is formed in a disk-like shape, and three elongated holes 483 are formed in the cam operation part 482 so as to be located above the respective bottom parts 460. The projection portion 481 is formed on the bottom part 460, and the projection portion 481 is inserted into the elongated hole 483. Furthermore, the projection portion 481 is guided by the elongated hole 483. That is, the cam mechanism 480*a* is a rotary cam mechanism, and the elongated hole 483 is formed in an extending manner in a direction intersecting with the direction in which the cam operation part 482 rotates.

According to the second embodiment, in the rotor 440 configured as described above, the cam operation part 482 rotates, thus moving the position of the bottom part 460 in the radial direction of the rotation of the cam operation part 482, and adjusting the position of the roller 475.

First modification of second embodiment

Figure 13:
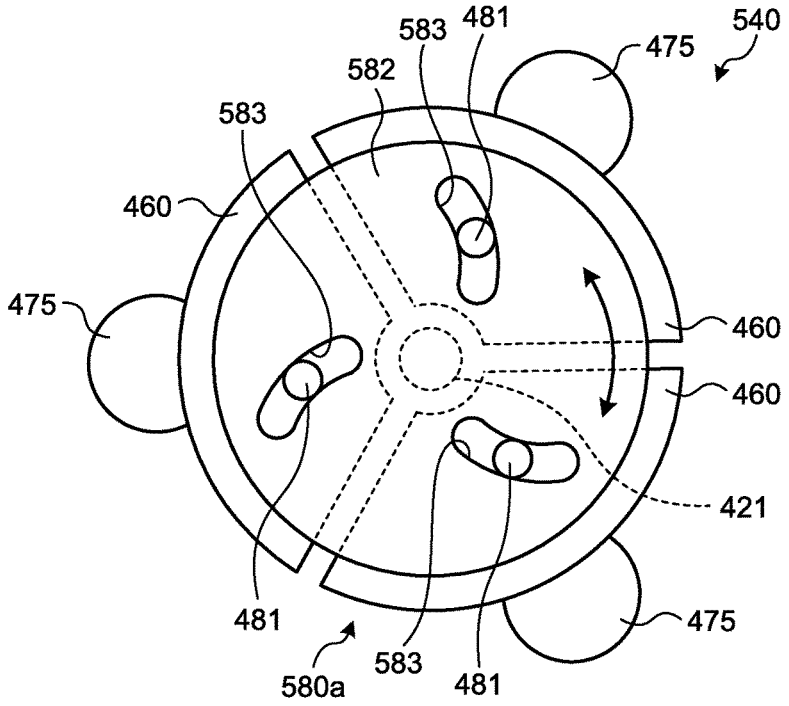
FIG. 13 is a conceptual explanatory view of a first modification of the rotor according to the second embodiment of the present invention.

Next, the first modification of the second embodiment is explained. FIG. 13 is a conceptual explanatory view illustrating the first modification of the rotor 440 according to the second embodiment of the present invention. Here, constitutional features identical with those in the second embodiment mentioned above are given same numerals, and their detailed explanations are omitted.

As illustrated in FIG. 13, a rotor 540 differs from the rotor 440 mentioned above in that an elongated hole 583 of a cam operation part 582 in a cam mechanism 580*a* is different in shape from the elongated hole 483 of the cam operation part 482. That is, the elongated hole 583 of the cam operation part 582 is formed in a curved shape extending in a direction intersecting with the direction in which the cam operation part 582 rotates. The rotor 540 configured as described above also causes the cam operation part 582 to rotate to move the position of the bottom part 460 in the radial direction of the rotation of the cam operation part 582, thereby adjusting the position of the roller 475. Furthermore, the elongated hole 583 is formed in a curved shape thus guiding the projection portion 481 more smoothly, and rotating the cam operation part 582 more smoothly.

Here, in the same constitution as that of the first embodiment mentioned above in the second embodiment and each of the modifications, it is possible to obtain the same manner of operation and advantageous effects as those of the first embodiment.

Here, the present invention is not limited to the above-mentioned embodiments. The present invention includes a case of constituting the above-mentioned respective constitutional features optionally by combining with each other. In addition, additional effects or modifications can easily be thought of by those skilled in the art. The more extensive aspect of the present invention is therefore not limited to the above-mentioned embodiment, and various modifications can be made.

In the above-mentioned embodiments, although the elongated hole formed in the cam operation part is illustrated as a through hole, the elongated hole may be a bottomed hole, and the cam operation part may be constituted so that the bottomed elongated hole guides the projection portion.

According to one embodiment of the present invention, it is possible to provide a pump device capable of adjusting the amount of depressing the tube by adjusting the position of the roller.

The invention claimed is:

1. A rotor configured to depress a tube so as to move liquid in the tube, the rotor comprising:

a rotary body configured to rotate about a rotational shaft;

a plurality of bottom parts attached to the rotary body;

a plurality of arm parts including respective rollers configured to revolve around the rotational shaft and depress the tube, the arm parts being attached to the respective bottom parts;

an elastic member configured to bias the roller to radially outside of the rotation of the rotary body; and an adjuster including a cam mechanism capable of defining a plurality of positional relations in the plurality of bottom parts configured to adjust a mutual positional relation between the bottom parts in a radial direction of the rotation of the rotary body, wherein the bottom parts are arranged around the rotational shaft, the cam mechanism includes a projection portion formed in each of the bottom parts, and a cam operation part capable of moving relative to the bottom parts, and the cam operation part has an elongated hole extending in a direction intersecting with an operation direction of the cam operation part, the projection portion being inserted into the elongated hole, the projection portion being guided by the elongated hole.

2. The rotor according to claim 1, wherein the adjuster adjusts a distance from each of the bottom parts to the rotational shaft in the bottom part.

3. The rotor according to claim 1, wherein the rollers are arranged in a rotation symmetric manner with respect to the rotational shaft.

4. The rotor according to claim 1, wherein in the cam mechanism, the elongated hole includes at least one operation-direction extending portion extending along an operation direction of the cam operation part.

5. The rotor according to claim 1, wherein the cam mechanism is capable of adjusting a position of the projection portion guided by the elongated hole in a stepless manner.

6. The rotor according to claim 5, further comprising a fine adjustment mechanism configured to finely adjust a position of the cam operation part.

7. The rotor according to claim 1, wherein two bottom parts out of the bottom parts are arranged facing each other in an opposed manner with respect to the rotational shaft interposed between the two bottom parts.

8. The rotor according to claim 1, further comprising a guide configured to enable the movement of the arm parts relative to the bottom parts.

9. A pump device comprising:

the rotor according to claim 1;

a housing configured to house the rotor and the tube; and a motor configured to function as a driving source of the rotation of the rotor.

* * * * *